US005528008A

United States Patent [19]

Danek

[11] Patent Number: 5,528,008

[45] Date of Patent: Jun. 18, 1996

[54] PRESSURE CONTROLLED ACTIVATING SWITCH FOR A HAND HELD TOOL

[76] Inventor: Michael Danek, Postfach, CH-7220 Schiers, Switzerland

[21] Appl. No.: 284,758

[22] Filed: Aug. 2, 1994

Related U.S. Application Data

[63] Continuation of Ser. No. 940,900, filed as PCT/CH92/00038, Feb. 24, 1992, published as WO91/12612 Aug. 22, 1991, abandoned.

[30] Foreign Application Priority Data

Feb. 27, 1991 [CH] Switzerland ..... 0586/91

[51] Int. Cl.[6] ..... H01H 9/06; H01H 3/02; G08C 21/00

[52] U.S. Cl. ..... 200/52 R; 178/18; 345/179

[58] Field of Search ..... 200/52 R, 61.41, 200/61.42, 61.58 R; 178/18; 364/705.03; 345/179; H01H 3/02, 9/06

[56] References Cited

U.S. PATENT DOCUMENTS

| | | | |
|---|---|---|---|
| 3,609,758 | 9/1971 | Buesing | 200/61.42 |
| 3,746,814 | 7/1973 | Lackey et al. | 200/505 |
| 3,995,131 | 11/1976 | Long | 200/547 |
| 4,007,364 | 2/1977 | Ojima et al. | 364/705.03 |
| 4,128,889 | 12/1978 | Ojima et al. | 200/5 A X |
| 4,491,688 | 1/1985 | Schaub et al. | 178/18 |
| 4,492,832 | 1/1985 | Taylor | 200/52 R |
| 4,523,063 | 6/1985 | Kroetsch | 200/61.41 |
| 5,004,871 | 4/1991 | Purcell | 178/18 |
| 5,109,141 | 4/1992 | Purcell | 178/18 |
| 5,410,334 | 4/1995 | Comerford | 345/179 |

FOREIGN PATENT DOCUMENTS

| | | | |
|---|---|---|---|
| 2118681 | 2/1972 | Germany | H01H 13/14 |
| 373518 | 1/1964 | Switzerland | H01H 9/06 |
| 446129 | 3/1968 | Switzerland | H01H 9/06 |

*Primary Examiner*—J. R. Scott

[57] ABSTRACT

A pressure controlled activating switch for a hand held tool comprises an elongated flexible barrel having an axial support member carried within the barrel and protruding from one end thereof. A plurality of gliding elements surround the axial support member and are mounted in the barrel for axial movement with respect to the barrel axis. A plurality of inserting elements are carried between the gliding elements and are moveable radially in the barrel. A connecting element is provided axially moveable within the barrel and is operatively disposed to activate a switch element. A spring or magnet maintains the gliding elements in a resting position and positioned with respect to the connecting element so that radial movement inwardly of the flexible barrel causes radial movement of the inserting elements which in turn causes axial movement of the gliding elements and connecting element to activate the switch element.

5 Claims, 3 Drawing Sheets

PRESSURE CONTROLLED ACTIVATING SWITCH FOR A HAND HELD TOOL

The present application is a continuation application of my application Ser. No. 07/940,900 filed as PCT/CH92/00038, published as WO91/12612, Aug. 22, 1991, now abandoned.

FIELD OF THE INVENTION

This invention relates to a pressure switch, especially for writing tools and other tools of similar form.

1. Background of the Invention

There are various pressure switches for these kinds of tools but they have the disadvantage that the switch actuating pressure must be applied to a restricted place on the tool.

The object of this invention is to provide a pressure switch that does not have the aforesaid disadvantage of the prior art and is simple and cheap.

2. Brief Description of the Invention

The invention provides a pressure operated switch for writing tool or the like having an elongated flexible barrel. An axial support member is carried within the barrel and protrudes from an end thereof. A plurality of gliding elements surround the axial support member and are mounted within the barrel for axial movement. A plurality of inserting elements are carried between the gliding elements and are moveable radially in the barrel. Also included is a connecting means axially moveable within the barrel and operatively disposed to activate a switch element. The gliding elements, inserting elements and connecting means are arranged within the barrel so that radial pressure on the barrel causes radial movement of the inserting elements which in turn causes axial movement of one or more of the gliding elements which in turn causes axial movement of the connecting means and activation of the switch element. Thus, radial inward movement of the barrel along an extended area thereof creates an axial movement which activates the switch.

DETAILED DESCRIPTION OF THE INVENTION

Figure 1:
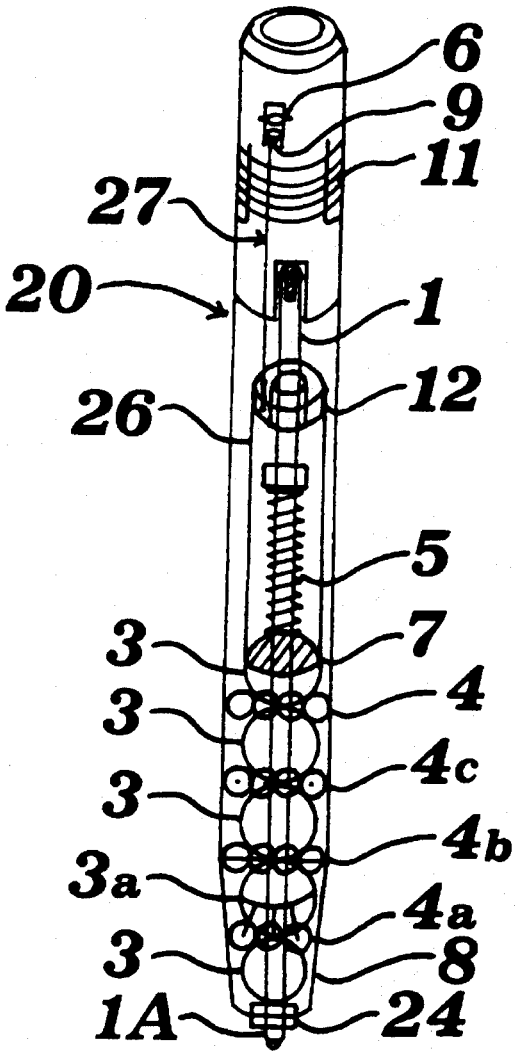
FIG. 1 is a schematic diagrammatic partially sectional view of one embodiment of the invention.

In the FIG. 1 (and FIGS. 3–7) embodiment of the invention a writing tool, generally indicated at (20), has an elongated flexible cover or barrel (8). An axial support member (1) is carried within the barrel and protrudes from one end to create the illustrated pen point (1A). Surrounding the axial support member (1) are a plurality of gliding elements (3), which are shown as balls (3, **3*a*). A plurality of inserting elements (4, 4*a*, 4*b*, and 4*c*) are carried between the flexible barrel (8) and pairs of balls (3, 3*a*). The balls (3) which are pressed together by spring means (5) are held between a lower support (24) and a clamp element (7) engaging the upper ball (3). A means such as a cylinder (26) slidably mounted on support (1) is connected at one end to clamp element (7), and at the other end to a leading part (12) which in turn is connected (through a means (27)) to a contact element (9) which operates to close (or open) a signal input device element (6**) such as a pressure counter, a time counter, an acoustical device, an electrical device, a visual display, a valve or a mechanical switch.

The operation of the pressure switch will be described for the writing tool described in FIG. 1. By radially pressing the flexible cover (8) along its length adjacent any of the inserting elements (4, **4*a*, 4*b* or 4*c*) the element (4, 4*a*, 4*b* or 4*c*) is moved between an adjacent pair of balls (3). The side pressure applied to an element (4) separates an adjacent pair of balls (3) and creates an upward axial linear movement of cylinder (26), causing leading part (12), means (27) and contact element (9) to move upward and activate signal input device element (6**).

Figure 2:
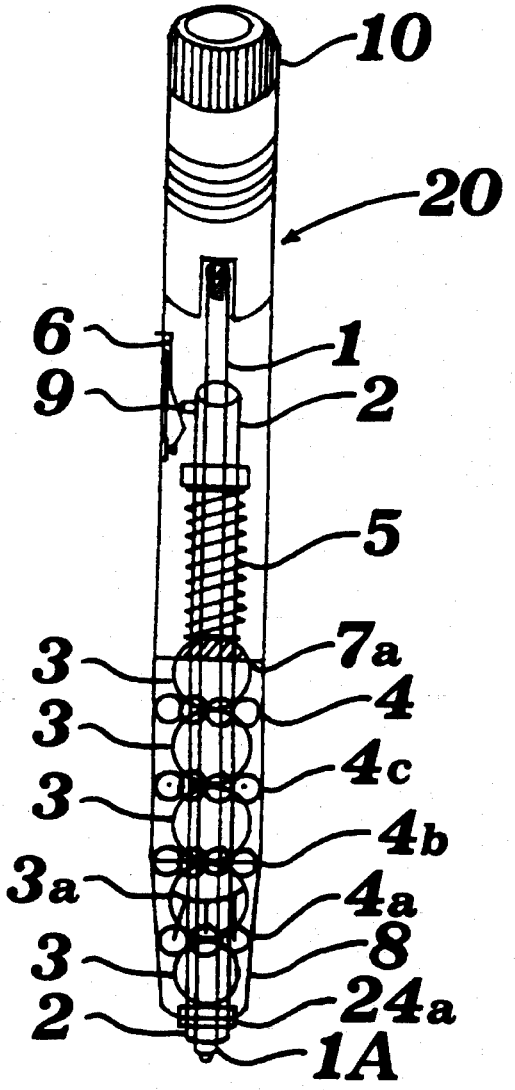
FIG. 2 is a schematic diagrammatic partially sectional view of another embodiment of the invention.
Figure 3:
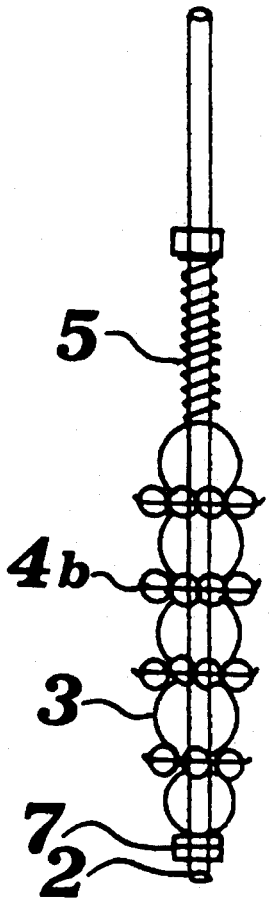
FIGS. 3–6 are side elevational views showing details of elements and subassemblies of the FIG. 1 embodiment of the invention.
Figure 4:
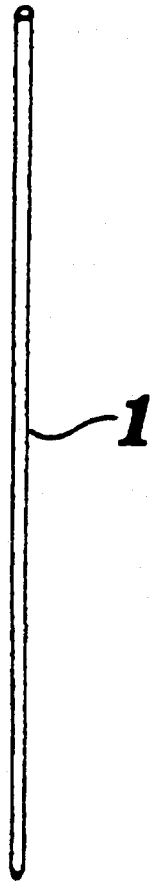
Figure 5:
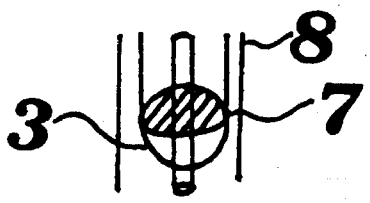
Figure 6:
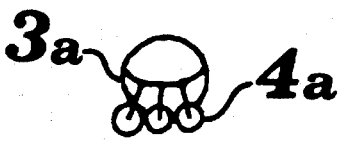
Figure 7:
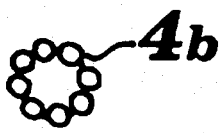
FIG. 7 is a top plan view showing details of the inserting elements of the present invention.

The relative position of input device element (6) and contact element means (9) may be adjusted by a slider (11) (FIG. 1) or by a button (10) (FIG. 2).

Referring now to FIG. 2, there is shown another embodiment of the invention. In this case, a cylinder (2) slidably surrounds axial support (1). The balls (3, **3*a*) are slidably mounted on support (2), except for the top ball (3) which is fixed to the cylinder (2) at a clamp element (7*a*). Cylinder (2) is slidably mounted in a lower support (24*a***).

According to the FIG. 2 embodiment, side pressure on barrel (8) results in radial movement of inserting elements (4, **4*a*, 4*b* or 4*c*) which in turn results in axial movement of balls (3, 3*a*) and cylinder support (2) and contact element (9) which is carried thereon to activate signal input device element (6**). Additionally, it can be used for the interruption of the writing process or for marking when the pressure reaches an adjustable degree.

The pressure switch may be used for teaching purposes or to make the switching easier.

Figure 8A:
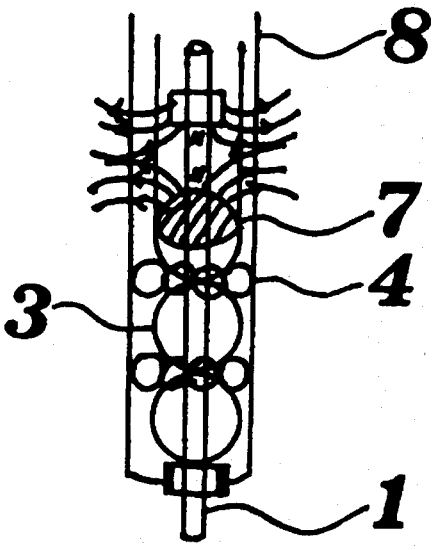
FIGS. 8A–8C are schematic diagrammatic partially sectional views of yet another embodiment of the invention.
Figure 8B:
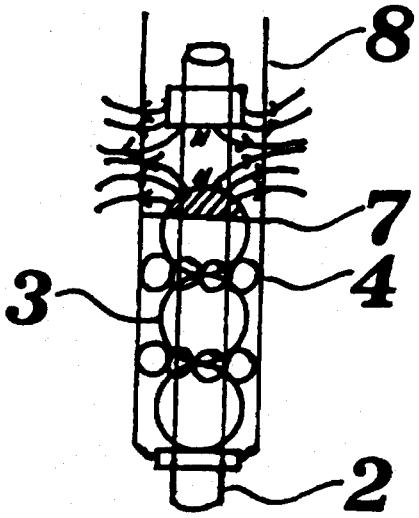
Figure 8C:
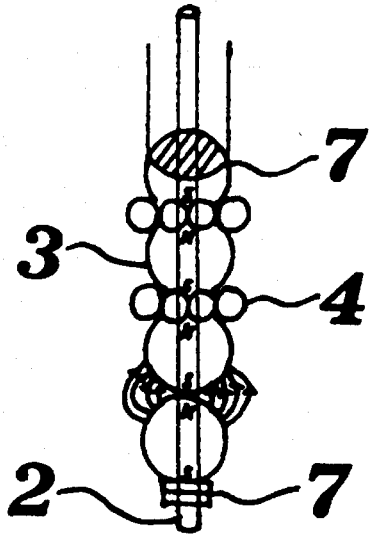

While a preferred embodiment of the invention involves the use of a spring (5) for normally holding the balls (3, **3*a*) in contact, the same result can be achieved by using magnetically attracted balls (3, 3*a*) which hold the balls together i.e. as shown in FIGS. 8A–8C**.

What is claimed is:

1. A pressure controlled activating switch for a hand held tool comprising an elongated flexible barrel, an axial support member carried within the barrel and protruding from one end thereof, a plurality of gliding elements surrounding the axial support member and mounted in the barrel for axial movement with respect to the barrel axis, a plurality of inserting elements carried between the gliding elements and moveable radially in the barrel, a connecting means axially moveable within the barrel and operatively disposed to activate a switch element, and means for maintaining the gliding elements in a resting position, said gliding elements being positioned with respect to the connecting means so that radial movement inwardly of the flexible barrel causes radial movement of the inserting elements which in turn causes axial movement of the gliding elements and connecting means whereto to activate the switch element.

2. The tool of claim 1 wherein the gliding elements comprise a plurality of balls arranged axially within said barrel.

3. The tool of claim 1 wherein the inserting elements comprise a plurality of smaller balls arranged for radial movement between adjacent surfaces of said axially arranged balls.

4. The tool of claim 1, wherein said means for maintaining the gliding elements in resting position comprises a spring applying an axial force to said second displacement means.

5. The tool of claim 1 wherein said means for maintaining the gliding elements in resting position comprises magnetic means.

* * * * *